US006580347B1

(12) United States Patent
Otte et al.

(10) Patent No.: US 6,580,347 B1
(45) Date of Patent: Jun. 17, 2003

(54) MAGNETIC CORE THAT IS SUITABLE FOR USE IN A CURRENT TRANSFORMER, METHOD FOR THE PRODUCTION OF A MAGNETIC CORE AND CURRENT TRANSFORMER WITH A MAGNETIC CORE

(75) Inventors: Detlef Otte, Gründau (DE); Jörg Petzold, Bruchköbel (DE)

(73) Assignee: Vacuumschmelze GmbH, Hanau (DE)

( * ) Notice: Subject to any disclaimer, the term of this patent is extended or adjusted under 35 U.S.C. 154(b) by 0 days.

(21) Appl. No.: 09/831,717

(22) PCT Filed: Nov. 15, 1999

(86) PCT No.: PCT/DE99/03630

§ 371 (c)(1),
(2), (4) Date: Sep. 17, 2001

(87) PCT Pub. No.: WO00/30131

PCT Pub. Date: May 25, 2000

(30) Foreign Application Priority Data

Nov. 13, 1998 (DE) ..... 198 52 423

(51) Int. Cl.[7] ..... H01F 27/02
(52) U.S. Cl. ..... 336/83; 336/213; 336/233
(58) Field of Search ..... 336/83, 212–213, 336/178, 233; 148/108

(56) References Cited

U.S. PATENT DOCUMENTS

| | | | | |
|---|---|---|---|---|
| 505,619 A | | 9/1893 | Williams et al. | |
| 4,451,876 A | * | 5/1984 | Ogata | 363/21 |
| 4,487,812 A | * | 12/1984 | Kawasaki et al. | 428/629 |
| 4,668,310 A | | 5/1987 | Kudo et al. | |
| 5,725,686 A | * | 3/1998 | Yoshizawa et al. | 148/307 |
| 5,922,143 A | * | 7/1999 | Verin et al. | 148/108 |

FOREIGN PATENT DOCUMENTS

| | | |
|---|---|---|
| DE | 2824749 | 12/1979 |
| DE | 3415435 | 10/1984 |
| DE | 36 20 617 A | 1/1987 |
| DE | 37 31 781 C1 | 3/1989 |
| DE | 196 53 428 C | 3/1998 |
| EP | 0 240 600 A | 10/1987 |
| EP | 0360574 | 3/1990 |

OTHER PUBLICATIONS

*Patent Abstracts of Japan, vol. 011, No. 343 (E–555), Nov. 11, 1987 & JP 62 124703 A (Mitsui Petrochem Ind Ltd), Jun. 6, 1987 abstract.

*Patent Abstracts of Japan, vol. 011, No. 161 (E–509), May 23, 1987 & JP 61 295601 A (Hitachi Metals Ltd), Dec. 26, 1986 abstract.

*Patent Abstracts of Japan, vol. 1996, No. 02, Feb. 29, 1996 & JP 07 272963 A (Toshiba Corp), Oct. 20, 1995 abstract.

* cited by examiner

*Primary Examiner*—Anh Mai
(74) *Attorney, Agent, or Firm*—Dean W. Russell; Kilpatrick Stockton LLP

(57) ABSTRACT

Magnetic cores including coiled amorphous ferromagnetic alloy strips are addressed. The composition of the alloy essentially corresponds to the formula $Co_a(Fe_{1-x}Mn_x)_bNi_cX_dSi_eB_fC_g$, where X is at least one of the elements V, Nb, Ta, Cr, Mo, W, Ge, and P; and a, b, c, d, e, f, and g are indicated in atom percent and meet the following conditions: $40 \leqq a \leqq 82$; $3 \leqq b \leqq 10$, $0 \leqq c \leqq 30$; $0 \leqq d \leqq 5$; $0 \leqq e \leqq 20$; $7 \leqq f \leqq 26$; $0 \leqq g \leqq 3$; with $15 \leqq d+e+f+g \leqq 33$ and $0 \leqq x \leqq 1$.

11 Claims, 3 Drawing Sheets

Typical Data:

$N_{prim}$ : 1...6
$I_{prim}$ : $5A_{eff}$..$120A_{eff}$ (max.)
$N_{sec}$ : 500 ...4000
$I_{sec} \approx -I_{prim} * N_{prim} / N_{sec}$
$R_B$ : 1Ω ...200 Ω (Burden)
$R_{cu}$ :1Ω...200 Ω (Winding)
$U_{signal}$ : 300 $mV_{eff}$ (max.)
Frequency: 50/60 Hz

MAGNETIC CORE THAT IS SUITABLE FOR USE IN A CURRENT TRANSFORMER, METHOD FOR THE PRODUCTION OF A MAGNETIC CORE AND CURRENT TRANSFORMER WITH A MAGNETIC CORE

FIELD OF THE INVENTION

The invention concerns a magnetic core which is suitable for use in a current transformer, a process for the production of this type of magnetic core, and a current transformer with this type of magnetic core.

BACKGROUND OF THE INVENTION

To detect the energy consumption of electrical devices and facilities in industrial and household use, energy meters are used. The oldest principle in use in this regard is that of the Ferrari meter. The Ferrari meter is based on energy metering via the rotation of a disk, connected with a mechanical register, which is driven by the fields of appropriate field coils which are proportional to the current and/or the voltage. For the expansion of the functional possibilities of energy meters, such as for multi-rate operation or remote reading, energy meters are used in which the current and voltage detection is performed via inductive current and voltage transformers.

A special application, in which a particularly high exactitude is required, is the detection of energy currents in the utility company sector. In this case, the quantities of energy generated by the respective power plants and stored in the high-voltage networks must be precisely determined on one hand, and, on the other hand, the changing portions of consumption or supply in the traffic between the utility companies are of great importance for accounting. The energy meters used for this purpose are multifunction built-in devices whose input signals for current and voltage are taken from the respective high and medium high voltage installations via cascades of current and voltage transformers and whose output signals serve for digital and graphic registration and/or display as well as for control purposes in the control centers. In this regard, the first transformer on the network side serves for isolated transformation of the high current and voltage values, e.g., 1 to 100 kA and 10 to 500 kV, into values which can be handled in the control cabinets, while the second transformers transform these in the actual energy meter into the signal level necessary for the measurement electronics in the range of less than 10 to 100 mV.

FIG. 1 shows an equivalent circuit diagram of this type of current transformer and the range of technical data that can occur in various applications. A current transformer 1 is shown here. The primary winding 2, which carries the current $I_{prim}$ to be measured, and a secondary winding 3, which carries the measured current $I_{sec}$ are located on a magnetic core 4, which is made from an amorphous soft-magnetic band. The secondary current $I_{sec}$ automatically establishes itself in such a way that the primary and secondary ampere turns are, in the ideal case, of equal size and aligned in opposite directions. The trace of the magnetic fields in this type of current transformer is illustrated in FIG. 2, with losses in the magnetic core not considered. The current in the secondary winding 3 then establishes itself according to the law of induction in such a way that it seeks to impede the cause of its occurrence, namely the temporal change of the magnetic flux in the magnetic core 4.

In the ideal current transformer, the secondary current is, when multiplied with the turns ratio, therefore equal to the negative of the primary current, which is illustrated by equation (1):

$$I_{sec}^{ideal} = -I_{prim} * (N_{prim}/N_{sec}) \tag{1}$$

This ideal case is never achieved, due to the losses in the burden resistance 5, in the copper resistance 6 of the secondary winding, and in the magnetic core 4.

Therefore, in the real current transformer, the secondary current has an amplitude error and a phase error relative to the above idealization, which is described by equation (2):

$$\text{Amplitudenfehler: } F(I) = \frac{I_{sec}^{real} - I_{sec}^{ideal}}{I_{sec}^{ideal}}; \tag{2}$$

$$\text{Phasenfehler: } \varphi = \phi(I_{sec}^{real}) - \phi(-I_{prim})$$

The output signals of this type of current transformer are digitized, multiplied, integrated and saved. The result is an electrical value which is available for the purposes mentioned.

The electronic energy meters used for energy metering in these applications operate "indirectly," so that only purely bipolar, zero-symmetric alternating currents must be measured in the meter itself. Current transformers which are assembled from magnetic cores made of highly permeable materials and which must be equipped with very many secondary turns, i.e., typically 2500 or more, to achieve lower measurement error via a smaller phase error $\phi$, serve for this purpose.

For the mapping of purely bipolar currents, current transformers are known whose magnetic cores consist of highly permeable crystalline alloys, particularly nickel-iron alloys, which contain approximately 80 weight-percent nickel and are known under the name "Permalloy." These have a phase error $\phi$ which is fundamentally very low. However, they also have the disadvantage that this phase error $\phi$ varies strongly with the current $I_{prim}$ to be measured, which is identical with the modulation of the transformer core. For a precise current measurement with changing loads, a costly linearization in the energy meter is therefore necessary with these transformers.

Furthermore, current transformers are known which operate based on ironless air-core coils. This principle is known as the Rogowski principle. In this way, the influence of the modulation on the phase error does not apply. Because the requirements for reliability of this type of current transformer must be very high in order to allow energy metering which can be calibrated, these designs are equipped with costly shields against external fields, which requires a high outlay for materials and assembly and is therefore cost intensive.

Furthermore, solutions are known in which a ferrite pot core provided with an air gap (gapped) is used as the magnetic core. This current transformer has very good linearity; however, due to the relatively low permeability of the ferrite, a very high number of turns in connection with a very large-volume magnetic core is required in order to achieve a low phase angle in the current transformer. Furthermore, this current transformer based on ferrite pot cores also has a high sensitivity to external interfering fields, so that shielding measures must also be taken here.

SUMMARY OF THE INVENTION

The invention has as its object the specification of a magnetic core which, when used in a current transformer, allows higher measurement accuracy of a current to be measured than the prior art. Furthermore, a,process for the production of this type of magnetic core and a current transformer with this type of magnetic core are to be specified.

The object is achieved by a magnetic core which is suitable for use in a current transformer and which is characterized in that it consists of a wound band made of an amorphous ferromagnetic alloy, it has a saturation permeability which is larger than 20,000 and smaller than 300,000, it has a saturation magnetostriction whose amount is smaller than 0.5 ppm, and it is essentially free from mechanical stresses. The magnetic core has a magnetic anisotropic axis along which the magnetization of the magnetic core aligns itself particularly easily and which is orthogonal to a plane in which a center line of the band runs, i.e., which runs orthogonal to the direction of the wound band. The alloy has a composition which essentially consists of the formula $$Co_a(Fe_{1-x}Mn_x)_bNi_cX_dSi_eB_fC_g$$

wherein X is at least one of the elements V, Nb, Ta, Cr, Mo, W, Ge, P, a to g are indicated in atom %, and a, b, c, d, e, f, g, and x meet the following conditions:

$$40 \leqq a \leqq 82;\ 3 \leqq b \leqq 10;\ 0 \leqq c \leqq 30;\ 0 \leqq d \leqq 5;\ 0 \leqq e \leqq 20;\ 7 \leqq f \leqq 26;\ 0 \leqq g \leqq 3;\ \text{with } 15 \leqq d+e+f+g \leqq 33 \text{ and } 0 \leqq x \leqq 1.$$

The permeability relates to an applied field strength, which lies in the plane in which the center line of the band lies, and the induction hereby produced.

It has been shown that in this type of magnetic core the dependence of the permeability on the magnetization is very small. The hysteresis loop of the magnetic core is therefore very narrow and linear.

Because the permeability is, at over 20,000, very large and in addition is essentially independent from the magnetic bias, the absolute phase error and the absolute amplitude error of a current transformer with this type of magnetic core are very small. The absolute amplitude error can be smaller than 1%. The absolute phase error can be smaller than 0.1°.

In addition to the magnetic core, the current transformer has at least one primary winding and one secondary winding, to which a burden resistance is connected in parallel and which terminates the secondary electric circuit at a low resistance.

Furthermore, it has been shown that the hysteresis loop of the magnetic core has a high linearity. Thus, a permeability ratio $\mu_{15}/\mu_4$ is less than 1.1 and a permeability ratio $\mu_{10}/\mu_{0.5}$ is less than 1.25, with $\mu_{0.5}$, $\mu_4$, $\mu_{10}$, and $\mu_{15}$ being the permeabilities at a field amplitude H of 0.5, 4, 10, and 15 mA/cm.

The small saturation magnetostriction and the alignment of the anisotropic axis are particularly advantageously effective on the high linearity of the hysteresis loop.

Due to the good linearity, the phase and the amplitude errors have essentially no dependence on the current to be measured.

Because the absolute phase error, the absolute amplitude error, and the dependence of the errors on the current to be measured are very small, a very exact current detection can be performed through the current transformer.

The invention is based on the knowledge that, with the alloy of the composition described, a magnetic core with the properties described can be produced through a suitable heat treatment. Very many parameters are thereby adjusted relative to one another so that the magnetic core has the properties described.

In the following, a heat treatment which is a process for the production of a magnetic core and which also achieves the object will be described:

After production and winding of the band for the magnetic core, the magnetic core is heated to a target temperature (relaxation temperature) between 380° C. and 500° C. The magnetic core is cooled from the target temperature to room temperature, with a magnetic field H>100 A/cm, preferably >1000 A/cm, which is parallel to the anisotropic axis of the magnetic core to be generated, switched on beginning, at latest, at the Curie temperature of the alloy. The Curie temperature $T_C$ is the temperature at which a spontaneous magnetization of the alloy begins. Depending on the composition of the alloy, which determines the level of the Curie temperature, and the permeability level to be achieved, the cooling occurs at rates between 0.1 and 10 K/min. The temperature-time trace can hereby be stationary, nonlinear, continuous, or discontinuous. The cooling time can hereby be between 0.25 and 60 hours.

The target temperature is selected so that it lies below the crystallization temperature of the alloy. The target temperature preferably lies at least 100° C. below the crystallization temperature of the alloy.

Furthermore, the target temperature is selected so that, in the alloys described, a very small saturation magnetostriction is achieved. The target temperature required for this depends on the ratio of Fe and Mn to Co. The larger this ratio is, the smaller the target temperature selected, in order to obtain a saturation magnetostriction which is as small as possible.

Both an equilibration of mechanical stresses and a small saturation magnetostriction are achieved by the heating.

A particularly high linearity of the hysteresis loop can be achieved if the ratio of the mechanical elastic stress tensor of the magnetic core, multiplied by the saturation magnetostriction, to the uniaxial anisotropy is smaller than 0.5.

It has been shown that the cooling period described leads to the achievement of high saturation permeability as well as an anisotropy sufficiently high for good linearity of the hysteresis loop. Due to the elimination of magnetostriction and stress described, it becomes possible, in spite of very small values of the uniaxial anisotropy, to produce highly linear hysteresis loops with very high permeabilities. The longer the cooling in the magnetic field lasts, the smaller the saturation permeability is and the larger the anisotropy is. This is because, below the Curie temperature, atomic regions of the alloy which have magnetic dipole moments spatially align more and more in the magnetic field, so that a preferred direction for the magnetization is formed, i.e., the anisotropic axis is formed. The more pronounced this alignment in the magnetic field is, the larger the uniaxial anisotropy becomes, but the lower the permeability becomes.

The alignment processes occurring in the magnetic field depend on the temperature in two ways. The higher the temperature is, the more mobile the atomic regions become and the more easily they align themselves. The lower the temperature is, the larger the driving force of the magnetic field on the magnetic dipole moments of the atomic regions, i.e., the larger the aligning force is which acts on the atomic regions. Through the duration of cooling described, these factors are optimally adjusted relative to one another, so that an anisotropy sufficiently high for good linearity is achieved at the same time as high permeability.

The magnetic field is selected in such a way that the saturation magnetization of the magnetic core is reliably achieved in its axial direction.

To achieve high permeabilities, the composition of the alloy is selected in such a way that the Curie temperature is as small as possible, taking into consideration other parameters to be optimized, e.g., a high saturation induction. The Curie temperature lies, for example, between 190° C. and 270° C. This is advantageous for technical and economic reasons, because, for reasons of linearity, fieldless cooling cannot be performed below the Curie temperature. A reduction of the Curie temperature is first achieved by increasing the metalloid content, i.e., the portion of Si and B, whereby the saturation induction also sinks simultaneously. If, however, additional Mn is added within the regions discussed, sinking of the Curie temperature while maintaining the saturation induction can be achieved.

Simultaneously, by increasing the metalloid content while keeping other parameters to be optimized, such as the saturation magnetostriction, in consideration, an increase of the crystallization temperature is achieved. This is advantageous because a high crystallization temperature allows better aging behavior of the magnetic core and a high target temperature, and thereby a better compensation of the mechanical stress.

Furthermore, in the selection of the composition of the alloy, another consideration is that the saturation induction of the magnetic core be as large as possible. This is advantageous because, with large saturation induction, the linearity range is increased and thereby a higher current can be reliably measured before saturation is reached and the linearity of the current mapping is thus destroyed. The saturation induction is larger the larger the ratio of Co, Fe, and Mn to the remainder of the alloy is. The crystallization temperature is thereby simultaneously reduced.

Due to the high permeability, the current transformer can have both exact current detection and a particularly small volume.

In regard to the characteristics required, particularly good current transformers can be achieved through the use of amorphous, ferromagnetic alloys which have a magnetostriction value $|\lambda_s|<0.1$ ppm, with the alloy having a composition which essentially consists of the formula $$Co_a(Fe_{1-x}Mn_x)_bNi_cX_dSi_eB_fC_g$$

whereby X is at least one of the elements V, Nb, Ta, Cr, Mo, W, Ge, and P, a to g are indicated in atom %, and a, b, c, d, e, f, g, and x meet the following conditions:

$$63 \leqq a \leqq 72;\ 3 \leqq b \leqq 10;\ 0 \leqq c \leqq 5;\ 0 \leqq d \leqq 3;\ 12 \leqq e \leqq 19;\ 7 \leqq f \leqq 20;\ 0 \leqq g \leqq 3 \text{ with } 20 \leqq d+e+f+g \leqq 30 \text{ and } x \leqq 0.5.$$

A further improvement can be achieved with current transformers which contain amorphous ferromagnetic alloys of the type mentioned above as the transformer core material, in which a, b, and c meet the following condition:

$$68 \leqq a+b+c \leqq 75.$$

The alloy systems mentioned above are characterized by very linear, extremely narrow hysteresis loops, with a permeability $\mu_4>120{,}000$ at a field amplitude H of 4 mA/cm easily able to be established with the process described.

The alloy systems according to the invention are almost completely free of magnetostriction. The magnetostriction is preferably established by a heat treatment, so that linear hysteresis loops with an ample usable induction range due to the high saturation induction of $B_S$=0.5 to 0.7 T and a very good frequency response in regard to the permeability and comparatively low hysteresis losses can be produced.

These types of highly linear current transformers are achieved with the alloy compositions which were particularly emphasized because, with a tailored heat treatment, a zero crossing of the saturation magnetostriction can be established. In addition, usage can be made of the circumstance that, during the typical heat treatment for establishing the properties, the temperature dependence of the permeability lies in or very near to the zero crossing.

Due to the high saturation induction, very high current can be measured before saturation is reached and the linearity of the current mapping is thus destroyed. Through fine tuning of the ratio of silicon to boron and of the ratio of Co, Fe, and Mn to the remainder of the alloy, a particularly high saturation induction can be achieved. The saturation induction can hereby the increased through increase of the portion of the ferromagnetic elements Co and Fe, but also through Mn, relative to the total metalloid content. In addition, Si, due to its 4 valence electrons, reduces the magnetic moment more strongly than B, with only 3 valence electrons. In this way, the saturation induction can be further increased, with the total metalloid content kept constant, by a suitable fine tuning of B to Si. The magnetostriction, which becomes more negative with sinking metalloid content, must then, however, again be compensated via the Fe content to such a degree that the zero crossing can finally be achieved through the target temperature.

Through fine tuning of the iron content to the manganese content, a saturation magnetostriction can be achieved, with selection of a suitable target temperature, which is smaller than 0.1 or even 0.05 ppm. Due to the small saturation magnetostriction, the interference anisotropy which competes with the uniaxial anisotropy is particularly small. A good linearity of the hysteresis loops can thereby be achieved even with small uniaxial anisotropies, which are a requirement for a high permeability.

The magnetic core preferably does not have an air gap. A current transformer with a magnetic core without an air gap has a particularly high immunity to external interfering magnetic fields without additional shielding measures. The magnetic core is, for example, a closed ring core, oval core, or rectangular core without an air gap. If the band has an axis of rotational symmetry, as in the case of the ring core, then the anisotropy axis is parallel to the axis of rotational symmetry.

In regard to the eddy current losses and thereby the trace of the permeability, a thickness $d \leqq 26\ \mu m$ has been shown to be a favorable range for the thickness of the band. In order, on the other hand, to achieve a narrow hysteresis loop which is as linear as possible, a band thickness $d \geqq 15$ has proved favorable. In the alloys according to the invention, the surface-conditioned portion of the interference anisotropies can hereby be surprisingly strongly reduced.

Particularly small coercive field strengths and thereby a particularly good linearity of the hysteresis loops are achieved if the band is provided on at least one surface with an electrically insulating film. On one hand, this causes an improved relaxation of the core, and, on the other hand, particularly low eddy current losses can also be achieved through the electrically insulating film.

The band is, for example, provided with the electrically insulating film on at least one of its two surfaces before winding. For this purpose, depending on the requirements of the materials of the insulating layer, an immersion, pass-through, spray, or electrolysis process is used on the band.

Alternatively, the wound magnetic core is subject to an immersion insulation before heating to the target temperature, so that the band is provided with the electrically insulating film. An immersion process in a partial vacuum has proven to be particularly advantageous.

In the selection of the insulating medium, care must be taken that, on one hand, it adheres well to the band surface, and, on the other hand, it does not cause any surface reactions which could lead to damage of the magnetic properties. For the alloys under discussion here, oxides, acrylates, phosphates, silicates, and chromates of the elements calcium, magnesium, aluminum, titanium, zirconium, hafnium, and silicon have proven to be effective and compatible insulators. Magnesium is particularly effective in.this regard when it is applied as a fluid preproduct containing magnesium onto the band surface and transforms itself into a dense film containing magnesium, whose thickness D can lie between 25 nm and 3 $\mu$m, during a special heat treatment, which does not influence the alloy. At the temperatures of the magnetic field heat treatment described above, the actual insulator film made of magnesium oxide is then formed.

The secondary winding of the current transformer can have a number of turns which is smaller than or equal to 2200. The primary winding of the current transformer can have a number of turns which is equal to 3. The current transformer can be designed for a primary current which is smaller than or equal to 20 A.

The heating to the target temperature is performed as quickly as possible. For example, the heating to the target temperature is performed at a rate between 1 to 15 K/min.

The magnetic core is, for example, kept at the target temperature between 0.25 and 4 hours in order to achieve the best possible equalization of the mechanical stresses. This time can be shorter the higher the target temperature is.

The cooling between the relaxation temperature and the Curie temperature is also performed as quickly as possible, e.g., at rates of 0.5–10 K/min. The cooling rate hereby regulates the portion of free volume and thereby the atomic alignment capability which is available at lower temperatures for establishing the anisotropy. After the Curie temperature is reached, cooling is performed at 0.1–5 K/min. in the applied field, which is orthogonal to the direction of the band. This cooling rate is selected in such a way that a uniaxial anisotropy of the desired size arises under the driving force of the magnetic field through the atomic reorientation. Because this uniaxial anisotropy is reciprocal to the permeability, a high permeability can be set with high cooling rates.

If, however, a somewhat higher uniaxial anisotropy induced by the magnetic field is set for linearization of the hysteresis loop or to increase the anisotropy field strengths, then a stationary temperature plateau can be introduced below the Curie temperature. The temperature is hereby to be selected low enough that the magnetic moments are as high as possible, on the other hand, however, high enough that the kinetics of the alignment process still progress fast enough. Depending on the effect, the length of the temperature plateau in the applied magnetic field can be between 0.1 and 24 h.

To produce the magnetic core, first, for example, an amorphous band is produced from a melt by means of rapid solidification technology, which is known in and of itself, and which is, for example, described in DE 37 31 781 C1. The amorphous alloy band is then wound without stress into the magnetic core. In order to reduce the interference anisotropies, this is preferably done in such a way that the band has a slight surface roughness.

The heat treatment is performed in such a way that the value of the saturation magnetostriction $\lambda_S$ changes in the positive direction during the heat treatment by an amount dependent on the composition of the alloy, until it lies in the range $|\lambda_S|<0.5$ ppm, preferably $|\lambda_S|<0.05$ ppm. This value can even be achieved if the amount of $\lambda_S$ in the "as quenched" condition of the band, i.e., directly after the casting process, is significantly above this value.

Depending on the alloy used, sweeping of the magnetic core with a reducing or at least passive protective gas can hereby be performed so that neither oxidations nor other reactions can occur on the band surface, with the exception of self-passivating and simultaneously also electrically insulating extremely thin metalloid oxide layers, which are acceptable in certain cases.

The magnetic core treated in this way is finally hardened, e.g., through impregnation, coating, envelopment with suitable plastic materials and/or encapsulation, and is provided with at least one of the secondary windings of the current transformer.

BRIEF DESCRIPTION OF THE DRAWINGS

In the following, exemplary embodiments of the invention are described with reference to the figures.

FIG. 6 is not to scale and only shows a few turns for better viewability.

DETAILED DESCRIPTION

With a magnetic core M only weighing 3.3 g, made from an amorphous ferromagnetic alloy with the composition $Co_{67,7}Fe_{3,8}Mo_{1,5}Si_{16,5}B_{10,5}$, a current transformer with a primary number of turns $N_1=3$ and a secondary number of turns $N_2=2000$ could be produced which is terminated at low resistance in: the secondary current loop via a burden resistance of 100 Ohm.

Figure 1:
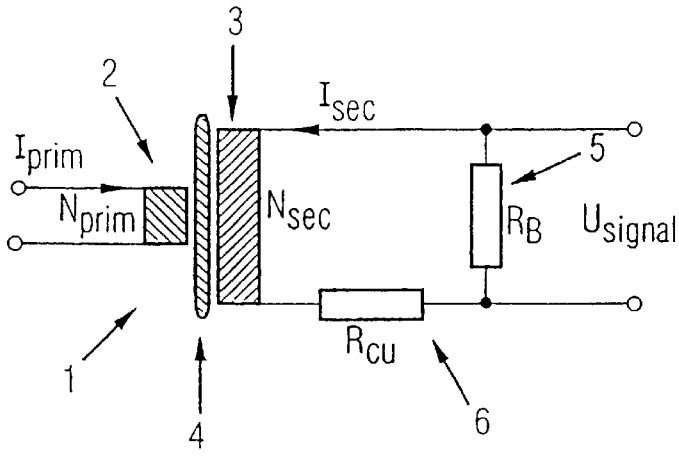
Figure 2:
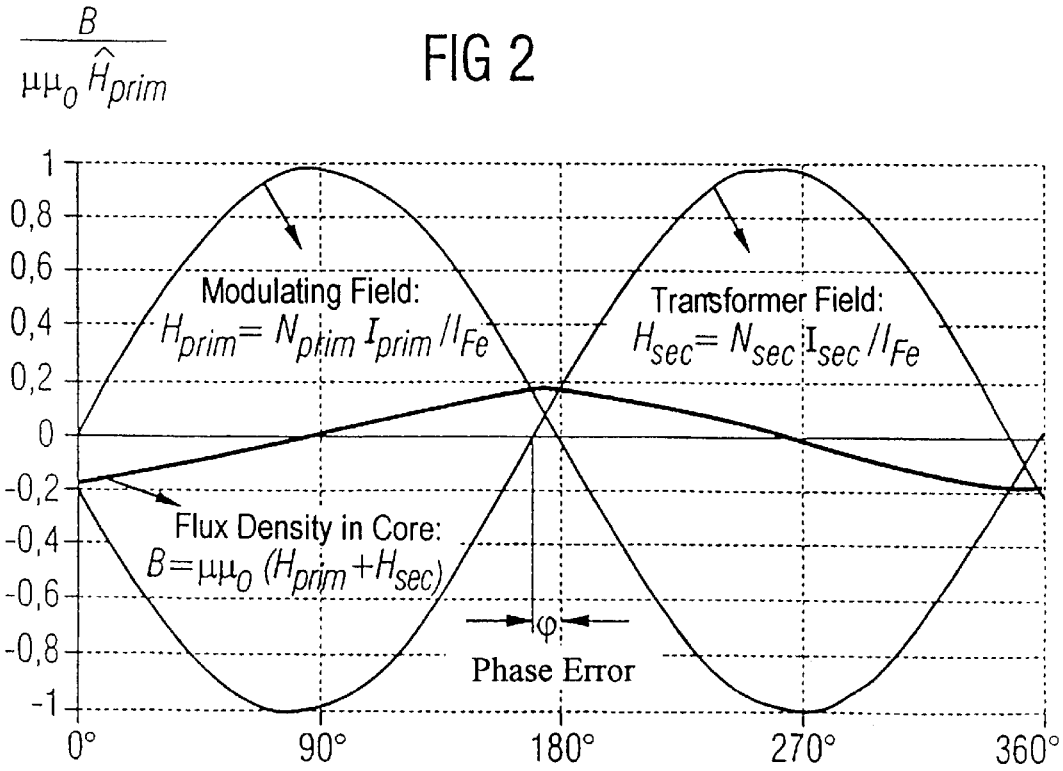
Figure 3:
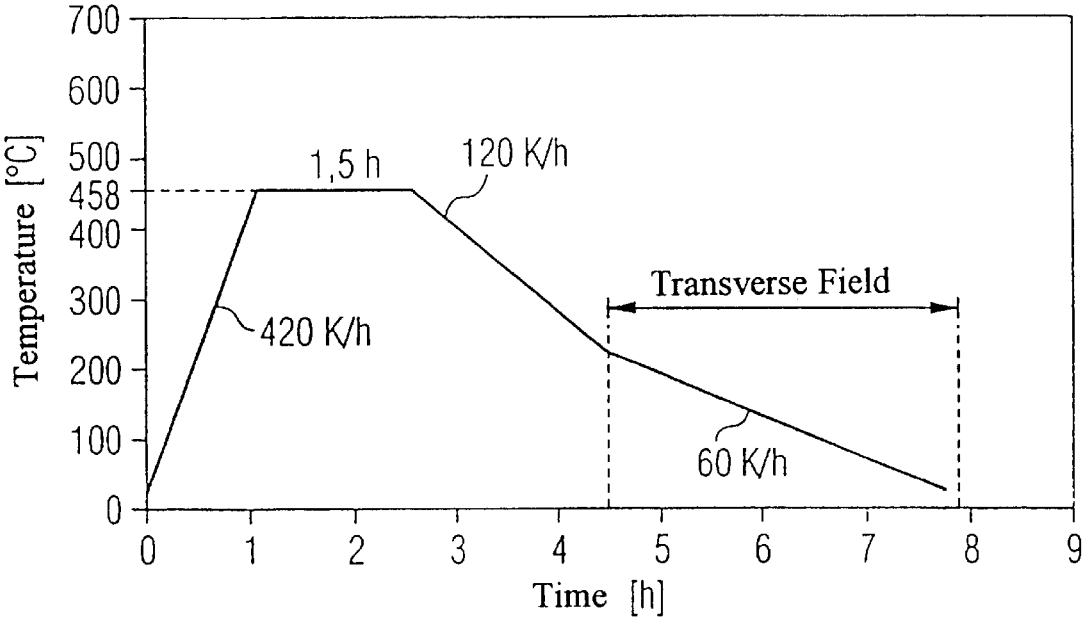
FIG. 3 shows the trace of the heat treatment of a magnetic core schematically.
Figure 6:
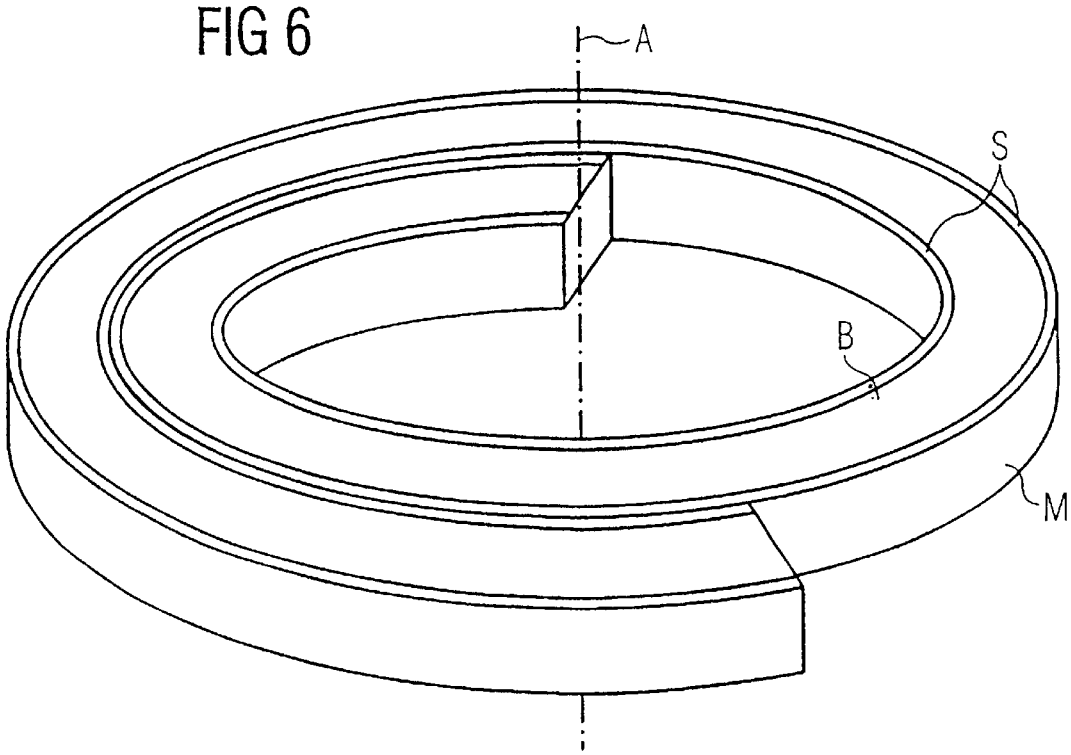
FIG. 6 schematically shows the magnetic core, which consists of a band with an insulating film, and its anisotropy axis.

For this purpose, the magnetic core M, which consists of a band coated with an approximately 250 nm thick insulating film S made of magnesium oxide, was subjected to the heat treatment depicted in FIG. 3. First, the magnetic core M was heated at a rate of approximately 420 K/h to the target temperature of approximately 458° C. within one hour and held there approximately 1.5 h. Subsequently, cooling was performed to approximately 220° C. within approximately two hours at a rate of approximately 120 K/h and to room temperature within approximately three hours at a rate of approximately 60 K/h. The cooling at the rate of 60 K/h occurred in a transverse magnetic field which was parallel to an axis of rotational symmetry of the magnetic core M. An anisotropic axis A parallel to the magnetic field hereby formed, along which the magnetization of the magnetic core M aligns itself particularly easily (see FIG. 6).

In this example, due to the heat treatment, the magnetostriction was reduced from $\lambda_S=-13.5*10^{-8}$ to the very small value of $-1.2*10^{-8}$. Simultaneously, previously existing mechanical stresses in the wound magnetic core M were almost completely eliminated and thus the condition $|\sigma|=0$ was achieved, with a being the mechanical elastic stress tensor. The requirement for high permeabilities was thereby met and $\mu$(50 Hz)=177,000 was, in fact, achieved. Therefore, a favorable combination of high permeability and very good linearity (i.e., $|\lambda_S|=0$ and $|\sigma|=0$) was achieved.

Figure 4:
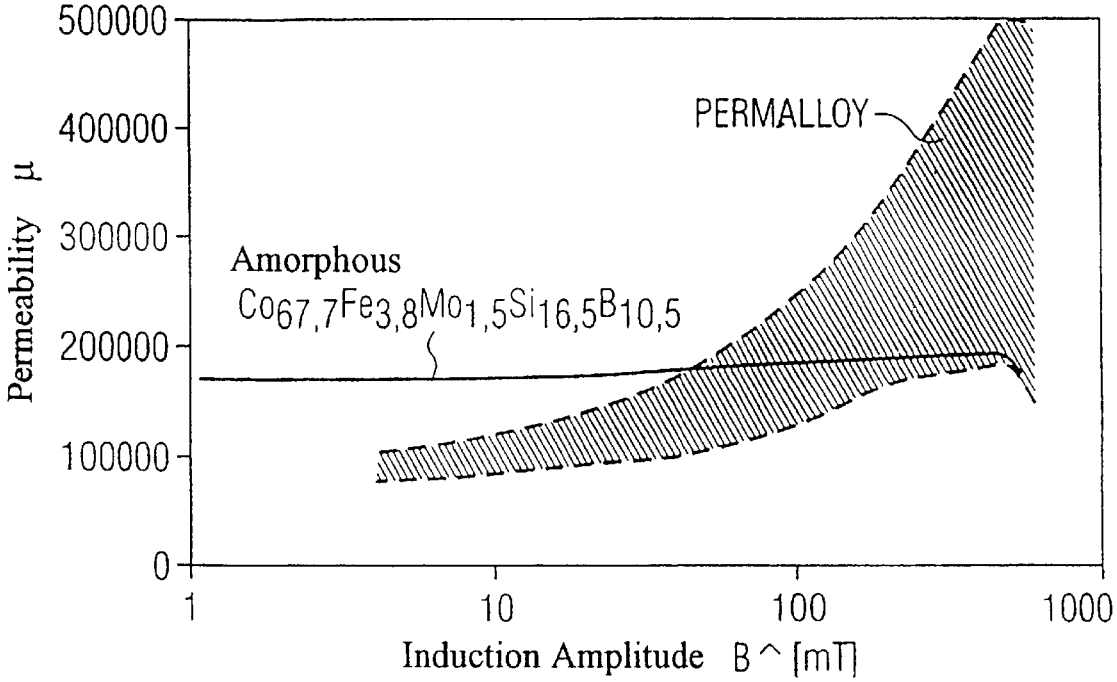
FIG. 4 shows a comparison of the dependencies of the permeabilities of the magnetic core and the permeabilities of Permalloy cores of an induction amplitude which is produced through an exciting magnetic field.

The hysteresis loop was hereby so linear that the modulation dependence of the permeability depicted in FIG. 4 ran nearly constant. Comparable properties were also measured at target temperatures of $T_o$=449° C. The modulation dependence of the permeability of conventional Permalloy alloys is shown for comparison in FIG. 4.

Figure 5:
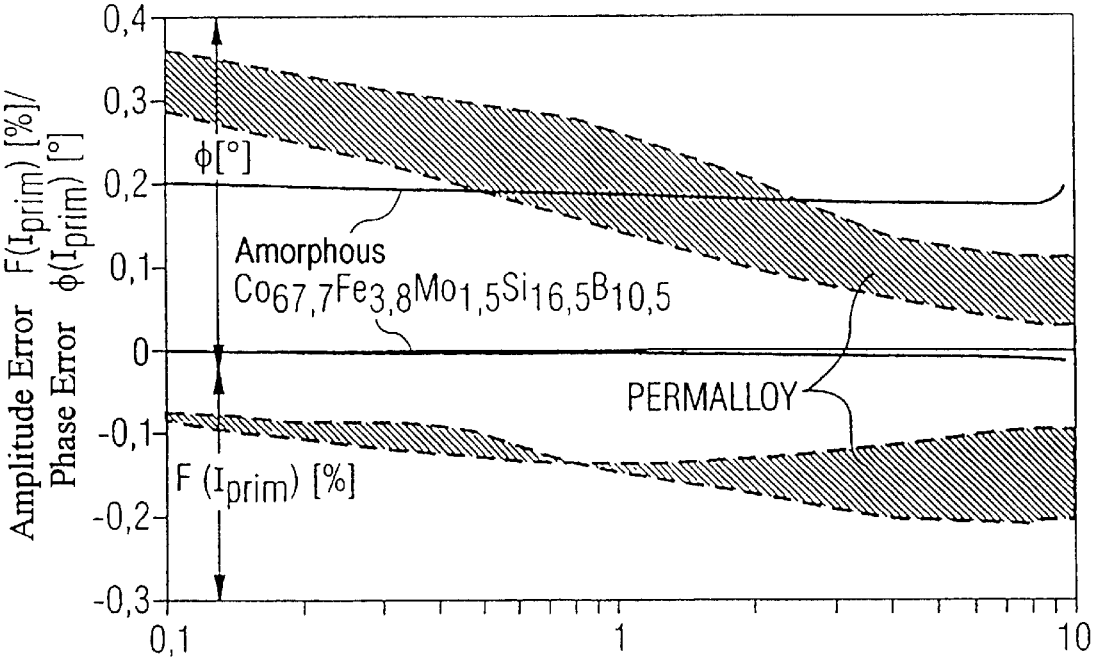
FIG. 5 shows the dependence of the amplitude error and the phase error on the current to be measured (primary current).

The traces of phase error ϕ and amplitude error F measured after winding on the current transformer described are illustrated in FIG. 5. The comparison to conventional Permalloy alloys hereby shows in an exemplary way the advantages of current transformers made of magnetostriction-free, highly permeable amorphous cores.

The current transformer had an average phase error ϕ of 0.19° and thereby a linearity of the phase angle Δϕ over a current range of 0.1 to 2 A of less than 0.02°. The permeability of this amorphous, heat-treated ferromagnetic alloy is 192,000 at a field amplitude H of 4 mA/cm. The magnetic core M used is a ring band core with the dimensions 19×15×5 mm with an iron crosssection of $A_{Fe}$=0.081 $cm^2$.

Similarly good current transformers could be produced with magnetic cores made of the following alloys:

$Co_{67,\ 62}Fe_{3,\ 7}Mo_{1,\ 5}Si_{16,\ 5}B_{10,\ 68}$ $Co_{68,\ 2}Fe_{3,\ 9}Mo_{1,\ 5}Si_{16,\ 3}B_{10,\ 1}$ $Co_{67,\ 65}Fe_{3,\ 4}Mn_{1,\ 0}Si_{16,\ 75}Mo_{0,\ 2}B_{11,\ 0}$ $Co_{68,\ 3}Fe_{3,\ 4}Mn_{1,\ 0}Si_{16,\ 5}Mo_{0,\ 5}B_{10,\ 3}$ $Co_{68,\ 2}Fe_{4,\ 1}Ni_{1,\ 4}Si_{14,\ 7}C_{0,\ 2}B_{11,\ 4}$.

In contrast to these examples, significantly worse magnetic properties were achieved with the use of one of the alloys already described (the composition $Co_{67,\ 7}Fe_{8,\ 8}Mo_{1,\ 5}Si_{16,\ 5}B_{10,\ 5}$) when the heat treatment was performed in another way. In a first change, the target temperature was raised up to 510° C. with the object of even better relaxation. The strongly nonlinear hysteresis loops occurring as a consequence had, however, due to stronger interference anisotropies from the onset of crystallization, an initial permeability of only 9,400.

If, however, the relaxation was performed at $T_o$=400° C., then the linearity of the hysteresis loops also worsened, with the initial permeabilities in this case lying at 97,000.

After a quick cooling in the transverse field at 2.5 K/min instead of at 1 K/min (cf. FIG. 3), the loops also rounded due to the uniaxial anisotropy $K_U$, which was now extremely small. The initial permeability lay, as a consequence, at only 127,000.

After a slow cooling in the transverse field at 0.5 K/min, the loop retained its pronounced linearity. The larger uniaxial anisotropy energy also led, however, to a reduced permeability of only 139,000.

What is claimed is:

1. Usage of a magnetic core for a current transformer, characterized in that it consists of a wound band (B) made of an amorphous, ferromagnetic alloy, it has a saturation permeability which is larger than 20,000 and smaller than 300,000, it has a saturation magnetostriction whose amount is smaller than 0.5 ppm, it is essentially free from mechanical stress, it has an anisotropy axis (A) along which the magnetization of the magnetic core (M) aligns itself particularly easily and which is orthogonal to a plane in which a center line of the band (B) runs, the alloy has a composition which essentially consists of the formula $$Co_a(Fe_{1-x}Mn_x)_bNi_cX_dSieB_fC_g$$

whereby X is at least one of the elements V, Nb, Ta, Cr, Mo, W, Ge, P, a to g are indicated in atom % and a, b, c, d, e, f, g, and x meet the following conditions:

$$40 \leqq a \leqq 82;\ 3 \leqq b \leqq 10;\ 0 \leqq c \leqq 30;\ 0 \leqq d \leqq 5;\ 0 \leqq e \leqq 20;\ 7 \leqq f \leqq 26;\ 0 \leqq g \leqq 3;\ \text{with } 15 \leqq d+e++f+g \leqq 533 \text{ and } 0 \leqq x \leqq 1.$$

2. Usage according to claim 1, characterized in that a, b, c, d, e, f, g, and x meet the following conditions:

$$63 \leqq a \leqq 73;\ 3 \leqq b \leqq 10;\ 0 \leqq c \leqq 5;\ 0 \leqq d \leqq 3;\ 12 \leqq e \leqq 19;\ 8f \leqq 20;\ 0 \leqq g \leqq 3;\ \text{with } 20 \leqq d+e+f+g \leqq 30 \text{ and } x \leqq 0.5.$$

3. Usage according to claim 2, characterized in that a, b, and c fulfill the following conditions:

$$68 \leqq a+b+c \leqq 75.$$

4. Usage according to claim 3, characterized in that the amount of the saturation magnetostriction is smaller than 0.1 ppm.

5. Usage according to claim 1, characterized in that the magnetic core (M) has a saturation magnetization $B_S$ of 0.5 to 0.7 T.

6. Usage according to claim 1, characterized in that the band (B) has a thickness d of 15 $\mu m \leqq d \leqq 26\ \mu m$.

7. Usage according to claim 1, characterized in that the band (B) is provided on at least one surface with an electrically insulating film (S).

8. Usage according to claim 7, characterized in that a film made of magnesium oxide is provided as the electrically insulating film (S).

9. Usage according to claim 8, characterized in that the electrically insulating film (S) has a thickness D of 25 $nm \leqq D \leqq 1\ \mu m$.

10. Usage according to claim 1, characterized in that it is implemented as a closed ring core, oval core, or rectangular core without an air gap.

11. Usage according to claim 1, characterized in that the ratio of its mechanical elastic stress tensor multiplied with the saturation magnetostriction to its uniaxial anisotropy is smaller than 0.5.

* * * * *